US006986403B1

(12) United States Patent
Rowland et al.

(10) Patent No.: US 6,986,403 B1
(45) Date of Patent: Jan. 17, 2006

(54) SLEEVE FOR COVERING A LADDER RUNG

(75) Inventors: Martha F. Rowland, Birmingham, AL (US); Frederick J. Diggle, Birmingham, AL (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 0 days.

(21) Appl. No.: 10/625,868

(22) Filed: Jul. 23, 2003

(51) Int. Cl.
*E04G 1/00* (2006.01)

(52) U.S. Cl. ..... 182/129; 182/230; 248/345.1

(58) Field of Classification Search ..... 182/129, 182/121, 107, 151, 194, 230, 214; 248/210, 248/345.1
See application file for complete search history.

(56) References Cited

U.S. PATENT DOCUMENTS

| | | | | |
|---|---|---|---|---|
| 3,941,159 | A | 3/1976 | Toll | |
| 4,009,735 | A | 3/1977 | Pinsky | |
| 4,105,220 | A | 8/1978 | Pacific | |
| 4,271,218 | A * | 6/1981 | Heckel et al. | 138/141 |
| 4,807,669 | A | 2/1989 | Prestidge, Sr. | |
| 4,823,845 | A | 4/1989 | Martin et al. | |
| 4,972,571 | A | 11/1990 | Cole et al. | |
| 5,067,588 | A | 11/1991 | Bendickson | |
| 5,123,453 | A | 6/1992 | Robbins | |
| 5,370,203 | A | 12/1994 | Kiska | |
| 5,437,071 | A * | 8/1995 | Feigenbaum | 5/663 |
| 5,673,768 | A * | 10/1997 | Schmitt et al. | 182/129 |
| 5,692,581 | A * | 12/1997 | Nelson et al. | 182/129 |
| 6,006,863 | A * | 12/1999 | LeGrand et al. | 182/129 |
| 6,016,846 | A | 1/2000 | Knittel et al. | |
| 6,145,618 | A | 11/2000 | Verenski | |
| 6,378,831 | B1 * | 4/2002 | Copeland, Jr. | 248/345.1 |
| 6,415,890 | B1 * | 7/2002 | Tucker et al. | 182/129 |
| 6,497,304 | B1 | 12/2002 | Leipziger | |
| 6,729,438 | B1 * | 5/2004 | Perrett | 182/129 |
| 2003/0093934 | A1 * | 5/2003 | Ruana | 40/660 |
| 2004/0074698 | A1 * | 4/2004 | Lawrence | 182/129 |

FOREIGN PATENT DOCUMENTS

| | | | |
|---|---|---|---|
| DE | 4125780 | * | 2/1993 |
| JP | 38821 | * | 2/2000 |

OTHER PUBLICATIONS

U.S. Appl. No. 10/625,865 filed Jul. 23, 2003.

* cited by examiner

*Primary Examiner*—Bruce A. Lev
(74) *Attorney, Agent, or Firm*—Potomac Patent Group PLLC

(57) ABSTRACT

A sleeve for covering a ladder rung includes a first end, a second end opposite the first end, and a first surface that defines an opening extending from the first end to the second end. The first surface is adapted to contact the ladder rung.

12 Claims, 4 Drawing Sheets

SLEEVE FOR COVERING A LADDER RUNG

BACKGROUND

The present application is related, generally, to a sleeve for covering a ladder rung. In the telecommunication and other industries, service personnel are routinely dispatched to various field sites to work on equipment that is located relatively high above the ground. When working on equipment located relatively high above the ground, service personnel often use a ladder to access the equipment. The service personnel frequently travel to the field site via a van or truck and transport a ladder to a field site by stowing the ladder on the top of the van or truck. The rungs of the ladder are usually fabricated of aluminum and include a plurality of grooves.

When service personnel are dispatched to a field site during icing conditions, a stubborn sheath of ice can quickly form between the plurality of grooves and around the rungs of the ladder. The sheath of ice can be resistant to chemical de-icers and can be extremely difficult to remove. The iced-up rungs may adversely affect the productivity of service personnel using such a ladder.

SUMMARY

In one general respect, the present invention is directed to a sleeve for covering a ladder rung. According to one embodiment, the sleeve includes a first end, a second end opposite the first end, and a first surface that defines an opening extending from the first end to the second end. The first surface is adapted to contact the ladder rung.

In another general respect, the present invention is related to a ladder. According to one embodiment, the ladder includes a first side rail, a second side rail opposite the first side rail, a rung connected to the first and second side rails, and a sleeve that covers the rung.

DESCRIPTION

Figure 1:
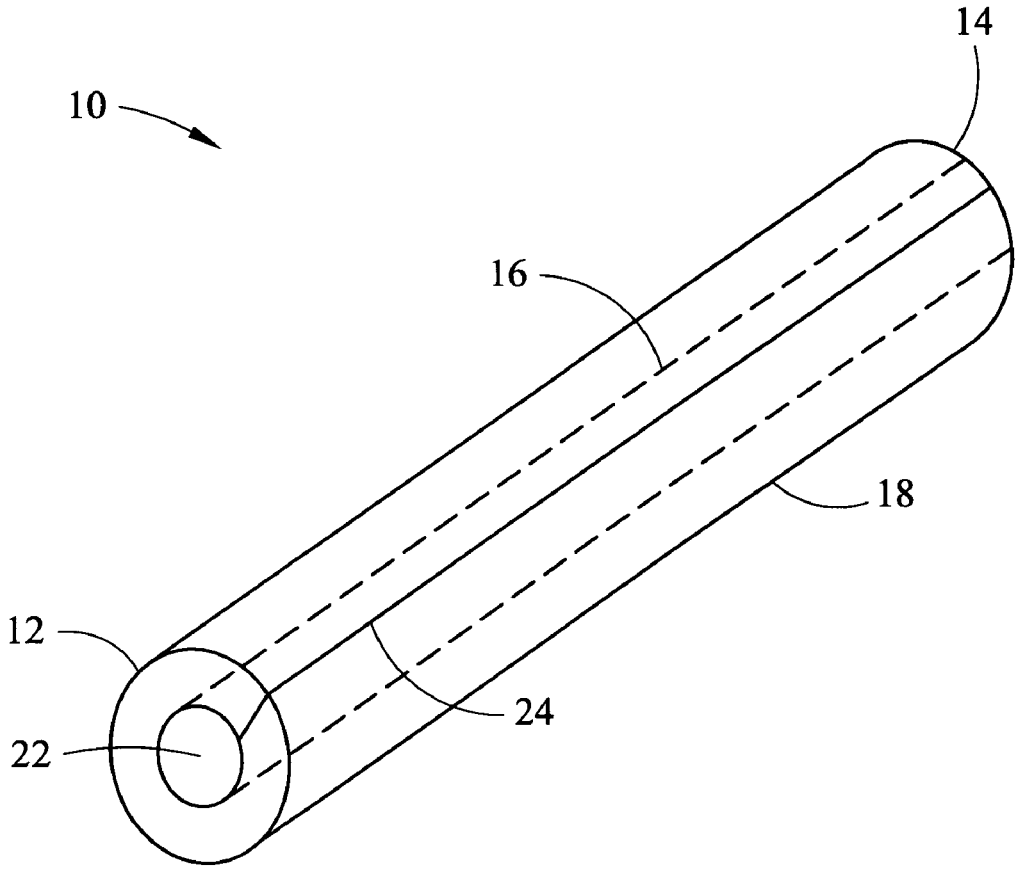
FIG. 1 illustrates one embodiment of a sleeve for covering a ladder rung.
Figure 2:
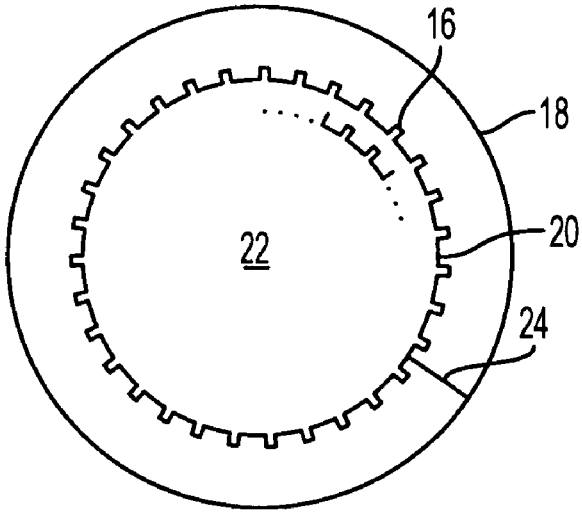
FIG. 2 illustrates one embodiment of a cross-section of the sleeve of FIG. 1.
Figure 4:
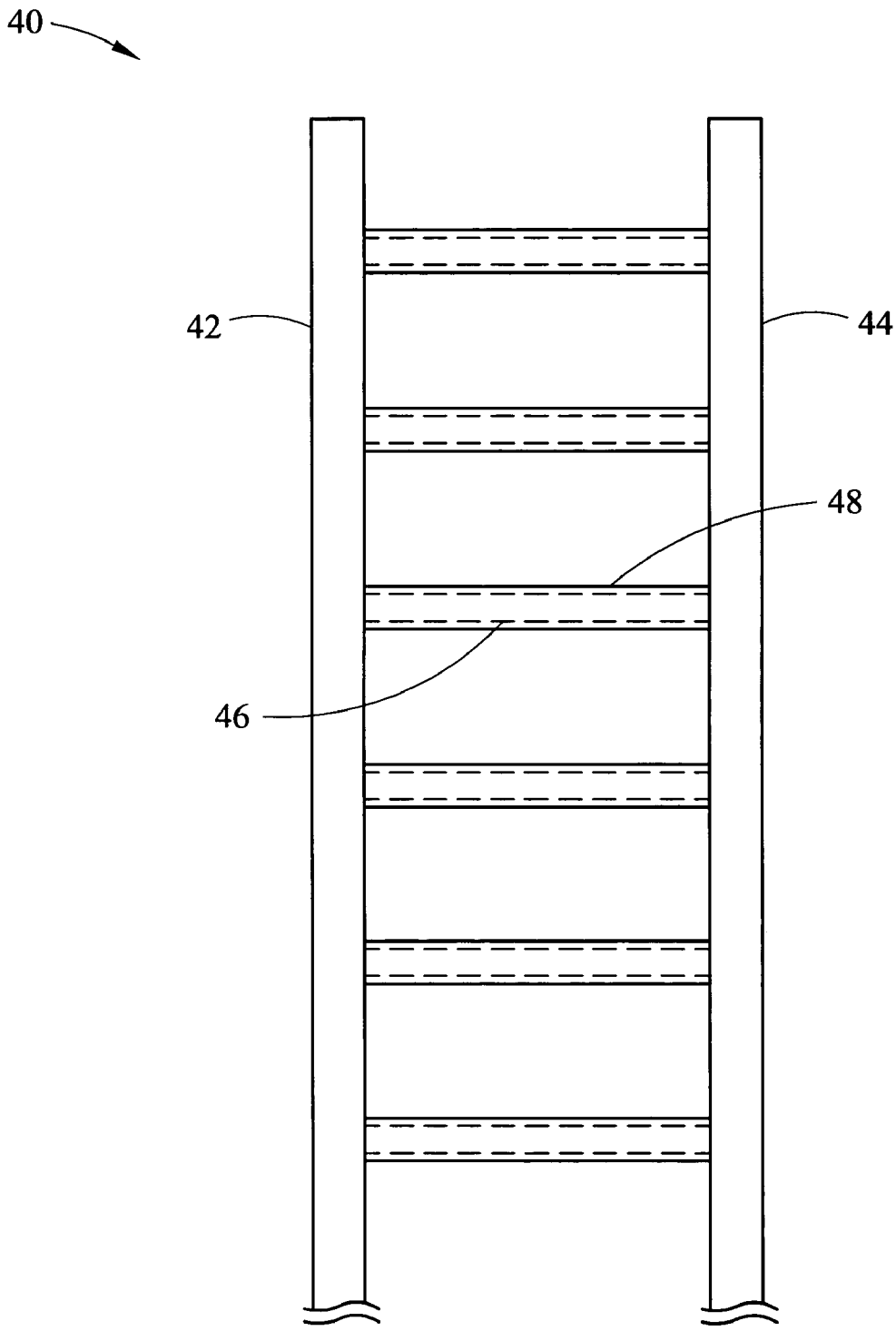
FIG. 4 illustrates one embodiment of a portion of a ladder.

FIG. 1 illustrates one embodiment of a sleeve 10 for covering a ladder rung such as the one shown in FIG. 4. The sleeve 10 is a cylindrical sleeve having a predetermined length and a predetermined diameter. The sleeve includes a first end 12 and a second end 14 opposite the first end 12. The sleeve 10 also includes a first surface 16 and a second surface 18 concentric with the first surface 16. The first surface 16 may be considered the inner surface and the second surface 18 may be considered the outer surface of the sleeve 10. The first surface 16, as shown in FIG. 2, may, in one embodiment, include a plurality of grooves 20. Thus, in one embodiment the first surface 16 is a grooved surface that includes both grooved portions and ungrooved portions. The grooves 20 may be spaced apart such that the ungrooved portions of the first surface 16 may coincide with a grooved portion of a ladder rung when the sleeve 10 covers the ladder rung. The first surface 16 defines an opening 22 that extends from the first end 12 to the second end 14. As shown in FIG. 2, the cross-section of the opening 22 may be generally circular.

According to one embodiment, the sleeve 10 may be fabricated from solid rubber. The solid rubber may include, for example, natural rubber or synthetic rubber, and the solid rubber may be vulcanized or cross-linked. According to another embodiment, the sleeve 10 may be fabricated from cellular rubber, and the cellular rubber may be vulcanized or cross-linked. The cellular rubber may be a closed cell rubber or an open cell rubber and may include, for example, natural rubber or synthetic rubber. The open cell rubber may be a foam such as, for example, a vinyl nitride foam.

The sleeve 10 may further comprise a slit 24 that extends from the first surface 16 to the second surface 18. The slit 24 also extends from the first end 12 to the second end 14 of the sleeve 10, and may be used to place the sleeve 10 around a ladder rung such as the one shown in FIG. 4.

Figure 3:
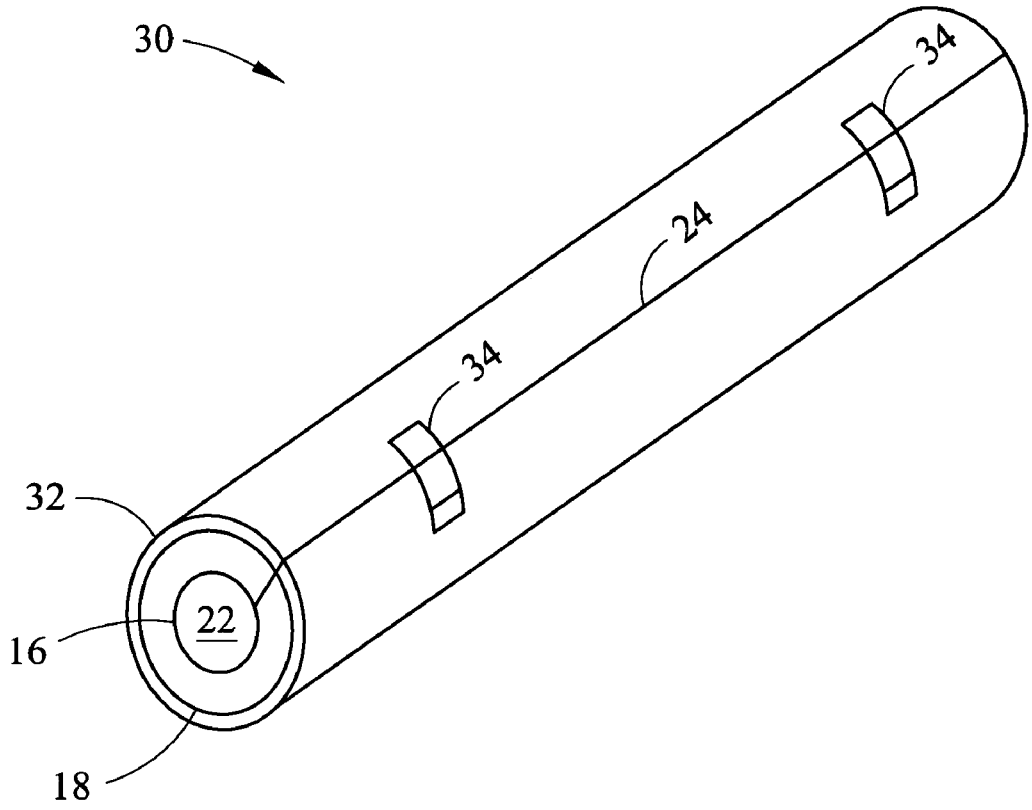
FIG. 3 illustrates another embodiment of a sleeve for covering a ladder rung.

FIG. 3 illustrates another embodiment of a sleeve 30 for covering a ladder rung such as the one shown in FIG. 4. The sleeve 30 is similar to the sleeve 10 of FIG. 1 and also includes a fabric layer 32 connected to the second surface 18. The fabric layer 32 may be fabricated from a waterproof material. The sleeve 30 also includes a fastener 34 connected to the fabric layer 32. The fastener 34 may be any suitable type of fastener such as, for example, a hook and loop fastener, and may serve to secure the sleeve 30 around a ladder rung. As shown in FIG. 4, the slit 24 may extend from the first surface 16 to the fabric layer 32 for this embodiment.

FIG. 4 illustrates one embodiment of a portion of a ladder 40. The ladder 40 may be any type of ladder such as, for example, a straight ladder or an extension ladder. The ladder 40 includes a first side rail 42 and a second side rail 44. The second side rail 44 is positioned opposite of and in parallel with the first side rail 42. The first and second side rails 42, 44 may be configured to include, for example, a web portion and a flange portion as is known in the art, or may be configured as box-type or tubular rails. The first and second rails 42, 44 may be fabricated from any suitable material such as, for example, wood, fiberglass or aluminum.

The ladder 40 also includes a rung 46 and a sleeve 48 that covers the rung 46. The rung 46 is connected to and in a perpendicular relationship with the first and second rails 42, 44. The rung 46 may be connected to the first and second rails 42, 44 in any suitable manner known in the art such as, for example, by ferrules or by preformed annuli or flanges. The rung 46 may be fabricated in any suitable shape such as, for example, a generally cylindrical shape having a circular cross-section, and the rung 46 may include a plurality of grooves (not shown) as is known in the art. The rung 46 may be fabricated from any suitable material such as, for example, aluminum.

The sleeve 48 may be similar to the sleeve 10 of FIG. 1 or to the sleeve 30 of FIG. 3. The sleeve 48 has a predetermined length that approximates the length of the rung 46 and the opening 22 defined by the first surface 16 has a predetermined diameter that approximates the diameter of the rung 46. When the rung 46 is covered by the sleeve 48, the first surface 16 of the sleeve 48 is in contact with the rung 46 and, in one embodiment, the ungrooved portions of the first surface 16 may coincide with the grooved portions of the rung 46. The sleeve 48 may serve to restrict the formation of ice on the rung 46.

In one embodiment, the sleeve 48 is a removable reusable sleeve that may be placed around the rung 46 and subsequently removed and reused. For example, when icing conditions are expected, the sleeve 48 may be placed around the rung 46, then subsequently removed when the ladder 40 is being used or when the icing conditions cease to exist. The cycle of placing the sleeve 48 around the rung 46, removing the sleeve 48, placing the sleeve 48 around the rung 46, etc. may be repeated any number of times.

As shown in FIG. 4, the ladder 40 may include a plurality of rungs 46 and a corresponding plurality of sleeves 48. Each of the rungs 46 may be connected to the first and second side rails 42, 44 as described hereinabove, and each sleeve 48 may cover a different rung 46.

While several embodiments of the invention have been described, it should be apparent, however, that various modifications, alterations and adaptations to those embodiments may occur to persons skilled in the art with the attainment of some or all of the advantages of the present invention. It is therefore intended to cover all such modifications, alterations and adaptations without departing from the scope and spirit of the present invention as defined by the appended claims.

What is claimed is:

1. A ladder comprising:

a first side rail;

a second side rail opposite the first side rail;

a rung connected to the first and second side rails; and a sleeve which covers a substantial portion of the rung between the first and second side rails, wherein:

(a) said rung includes a plurality of grooves, (b) said sleeve includes an outer surface and an inner surface, said inner surface having a plurality of grooved portions and a plurality of ungrooved portions, (c) said ungrooved portions of said inner surface of said sleeve mating with said grooved portion of said rung, (d) said outer surface of said sleeve is ungrooved, and (e) said sleeve extends around substantially an entire circumference of said rung.

2. The ladder of claim 1, wherein the sleeve is a cylindrical sleeve having a predetermined length and a predetermined diameter.

3. The ladder of claim 1, wherein the sleeve includes one of solid rubber and cellular rubber.

4. The ladder of claim 3, wherein the cellular rubber includes closed cell rubber.

5. The ladder of claim 3, wherein the cellular rubber includes open cell rubber.

6. The ladder of claim 5, wherein the open cell rubber includes foam.

7. The ladder of claim 1, wherein the sleeve further includes a slit that extends from the first surface to a second surface of the sleeve.

8. The ladder of claim 7, wherein the slit extends from the first end of the sleeve to the second end of the sleeve.

9. The ladder of claim 1, wherein the sleeve further includes a fabric layer connected to a surface of the sleeve.

10. The ladder of claim 9, wherein the fabric layer is waterproof.

11. The ladder of claim 9, wherein the sleeve further includes a fastener connected to the fabric layer.

12. The ladder of claim 1, wherein the sleeve is removable.

* * * * *